US008991109B2

(12) United States Patent
Sentry et al.

(10) Patent No.: US 8,991,109 B2
(45) Date of Patent: Mar. 31, 2015

(54) ANCHORAGE SYSTEM

(75) Inventors: Matthew Robert Sentry, Port Melbourne (AU); Leonard Francis Carrigan, Pascoe Vale South (AU)

(73) Assignee: Geotech Pty Ltd, Port Melbourne, Victoria (AU)

( * ) Notice: Subject to any disclaimer, the term of this patent is extended or adjusted under 35 U.S.C. 154(b) by 170 days.

(21) Appl. No.: 13/518,708

(22) PCT Filed: Dec. 23, 2010

(86) PCT No.: PCT/AU2010/001724

§ 371 (c)(1), (2), (4) Date: Aug. 7, 2012

(87) PCT Pub. No.: WO2011/075779

PCT Pub. Date: Jun. 30, 2011

(65) Prior Publication Data

US 2012/0297703 A1 Nov. 29, 2012

(30) Foreign Application Priority Data

Dec. 23, 2009 (AU) ..... 2009906252

(51) Int. Cl.
*E02D 5/74* (2006.01)
*E04C 5/12* (2006.01)

(52) U.S. Cl.
CPC ..... *E04C 5/122* (2013.01); *E04C 5/127* (2013.01)
USPC ..... 52/166

(58) Field of Classification Search
CPC ..... E04C 5/12; E04C 5/122; E04C 5/125; E04C 5/127
USPC ..... 52/166, 223.1, 223.4, 223.6–223.14, 52/745.21
See application file for complete search history.

(56) References Cited

U.S. PATENT DOCUMENTS 4,074,493 A * 2/1978 Outram ..... 52/848
4,150,473 A * 4/1979 Dietrich ..... 29/461
4,171,176 A * 10/1979 Yamada ..... 405/257

(Continued)

FOREIGN PATENT DOCUMENTS

CN 101117838 A 2/2008
GB 1024696 3/1966

(Continued)

*Primary Examiner* — Mark Wendell
*Assistant Examiner* — Keith Minter
(74) *Attorney, Agent, or Firm* — Fitzpatrick, Cella, Harper & Scinto

(57) ABSTRACT

An anchorage system is provided which includes: a composite tendon (2) comprising an assembly of elongate elements (4, 5) held together and an anchor head including a casing (6). The individual elongate elements (4, 5) are separated from each other at one end extending into the anchor head, and the anchor head casing (6) is filled with an adhesive medium (10) to secure the separated elements (4, 5) in the casing (6). A method for installing an anchorage system is also provided including the steps of: inserting in a borehole at least one composite tendon (2) comprising an assembly of elongate elements (4, 5) held together; separating the individual elongate elements (4, 5) from each other over a pre-determined bonded anchor head length (22); placing an anchor head casing (6) around the separated elements (4, 5); and filling the anchor head casing (6) with an adhesive medium (10), whereby once the adhesive medium has set, the separated elements (4, 5) are securely fixed into the anchor head (6).

13 Claims, 8 Drawing Sheets

(56) References Cited

U.S. PATENT DOCUMENTS

| | | | | | |
|---|---|---|---|---|---|
| 4,442,646 | A * | 4/1984 | Prevedini | 52/223.13 |
| 4,486,991 | A * | 12/1984 | Rahlwes et al. | 52/223.13 |
| 4,663,907 | A * | 5/1987 | Garcia-Mansilla Ripoll | 52/223.13 |
| 4,693,044 | A * | 9/1987 | Jartoux | 52/223.14 |
| 4,694,623 | A * | 9/1987 | Herrmann | 52/223.13 |
| 4,819,393 | A * | 4/1989 | Augoyard | 52/223.13 |
| 4,884,377 | A * | 12/1989 | Matt | 52/98 |
| 4,941,303 | A * | 7/1990 | Jartoux | 52/223.13 |
| 5,149,385 | A * | 9/1992 | Kurauchi et al. | 156/85 |
| 5,263,291 | A * | 11/1993 | Knight | 52/223.13 |
| 5,289,626 | A * | 3/1994 | Mochida et al. | 29/452 |
| 5,345,742 | A * | 9/1994 | Rogowsky et al. | 52/698 |
| 5,493,828 | A * | 2/1996 | Rogowsky et al. | 52/223.13 |
| 5,580,642 | A * | 12/1996 | Okamoto et al. | 428/212 |
| 5,596,854 | A * | 1/1997 | Crigler | 52/223.13 |
| 5,701,707 | A * | 12/1997 | Sorkin | 52/223.13 |
| 5,809,710 | A * | 9/1998 | Jungwirth et al. | 52/223.1 |
| 6,385,928 | B1 * | 5/2002 | Paulshus et al. | 52/223.13 |
| 6,476,326 | B1 * | 11/2002 | Fuzier et al. | 174/95 |
| 6,519,909 | B1 * | 2/2003 | Fawley | 52/834 |
| 6,571,518 | B1 * | 6/2003 | Barley | 52/223.13 |
| 6,578,328 | B2 * | 6/2003 | Bournand et al. | 52/223.13 |
| 6,684,585 | B2 * | 2/2004 | Campbell | 52/223.13 |
| 6,692,829 | B2 * | 2/2004 | Stubler et al. | 428/379 |
| 7,055,288 | B2 * | 6/2006 | Coogan | 52/222 |
| 7,056,463 | B2 * | 6/2006 | Ohta | 264/228 |
| 7,174,684 | B2 * | 2/2007 | Nuetzel et al. | 52/223.13 |
| 7,181,890 | B2 * | 2/2007 | Nuetzel | 52/223.13 |
| 7,541,089 | B1 * | 6/2009 | Miksic et al. | 428/379 |
| 7,553,108 | B2 * | 6/2009 | Langwadt et al. | 405/259.1 |
| 7,585,562 | B2 * | 9/2009 | Hasui et al. | 428/378 |
| 7,596,915 | B2 * | 10/2009 | Lee et al. | 52/223.6 |
| 7,726,082 | B2 * | 6/2010 | Hayes et al. | 52/223.13 |
| 7,886,490 | B2 * | 2/2011 | Maekawa et al. | 52/223.14 |
| 8,065,845 | B1 * | 11/2011 | Sorkin | 52/223.13 |
| 8,069,624 | B1 * | 12/2011 | Sorkin | 52/223.13 |
| 8,104,242 | B1 * | 1/2012 | Fouad et al. | 52/223.4 |
| 8,256,173 | B2 * | 9/2012 | Sarkisian et al. | 52/223.6 |
| 8,425,143 | B2 * | 4/2013 | Kondo et al. | 403/368 |
| 2001/0007185 | A1 * | 7/2001 | Belbeoc'h | 52/223.13 |
| 2002/0078643 | A1 * | 6/2002 | Belbeoc'h | 52/223.13 |
| 2004/0148882 | A1 * | 8/2004 | Hayes | 52/223.14 |
| 2006/0179742 | A1 * | 8/2006 | Mathews et al. | 52/223.13 |
| 2009/0126296 | A1 * | 5/2009 | Veronesi et al. | 52/223.1 |
| 2010/0186313 | A1 * | 7/2010 | Stanford et al. | 52/125.1 |
| 2011/0016813 | A1 * | 1/2011 | Dubon et al. | 52/309.3 |
| 2011/0120048 | A1 * | 5/2011 | Perry | 52/745.2 |
| 2011/0192111 | A1 * | 8/2011 | White et al. | 52/699 |
| 2012/0297694 | A1 * | 11/2012 | Kim et al. | 52/1 |
| 2013/0140509 | A1 * | 6/2013 | Domage | 254/228 |
| 2013/0152496 | A1 * | 6/2013 | Sinclair | 52/223.13 |
| 2013/0174499 | A1 * | 7/2013 | Densmore et al. | 52/125.4 |
| 2013/0309521 | A1 * | 11/2013 | Lambert | 428/594 |

FOREIGN PATENT DOCUMENTS

| | | |
|---|---|---|
| JP | 9-209501 A | 8/1997 |
| JP | 10-82178 A | 3/1998 |

* cited by examiner

Figure 1 – Prior Art

Figure 2 – Prior Art

Figure 5 – Prior Art

ANCHORAGE SYSTEM

BACKGROUND OF THE INVENTION

Field of the Invention

The present invention relates generally to anchorage systems and, in particular, to ground anchorage systems suitable for underground structures and above ground structures. It should be understood however that the invention is intended for broader application and use.

Ground anchors are an integral construction technique for numerous civil engineering applications ranging from deep excavation support to resistance of structural uplift and overturning of superstructures. Ground anchorage systems can be designed to be temporary, such as for use in temporary wall support in deep excavations. They can also be designed to be permanent for use in structures, for example, bridges and dams.

There are two significant types of anchorage systems which are in use; wedge type systems and bond type systems. Essentially, a wedge type anchorage system consists of steel wedges to grip single or multiple tendons in a tube with an inner conical profile and an outer cylindrical surface. Bond type anchorage systems on the other hand consist of a steel housing inside which single or multiple tendons are bonded by filling grout.

As used herein, a tendon is an elongate member adapted to be placed under load in an anchorage system. A tendon may consist of a single wire or strand, but more usually consists of a plurality of strands held together, for example by being helically wound.

A current wedge type anchorage system 130 is shown in FIG. 1. The end of a tendon 100 comprising several helically wound wires is inserted into a wedge-shaped barrel 110 that can be compressed inwardly is adapted to be forced into a tapered aperture 125 in a surrounding anchor block 120 to compress the barrel inwardly thereby securing the barrel and the end of the tendon in the anchor block. Once external forces are applied to the tendon 100, the wedge 110 can be located into the anchor block 120. Locking off of the tendon 100 is achieved by releasing the external force applied to the tendon 100, thus allowing the tendon 100 to be securely housed in the barrel and wedge 110 which is in turn securely housed into the anchor block 120.

In the case of a tendon formed from composite material, this compressive action of the wedges onto the tendon induced by the housing of the wedges into the anchor block, produces high concentrations of lateral stresses, causing premature fibre rupture of the tendon.

Present anchorage systems using steel tendons have the disadvantage that they are susceptible to corrosion and, as such, anchorage system standards require the use of double corrosion protection systems encapsulating the steel strands, to ensure a serviceable design life.

Most FRP anchorage systems alter the physical properties of the tendons being used, this is disadvantageous because altering of the properties may cause corrosion of the tendons and they may not perform as expected. Furthermore, in the case of bond type systems, the bond length required can be substantial, making it very difficult to work in areas where space is a premium. In addition, because a lot of material is required for the long bond length, costs are increased.

It is therefore desirable to provide an anchorage system which is less susceptible to corrosion with a minimal bond length.

Discussion or mention of any piece of prior art in this specification is not to be taken as an admission that the prior art is part of the common general knowledge of the skilled addressee of the specification in Australia or any other country.

SUMMARY OF THE INVENTION

According to one aspect of the present invention there is provided an anchorage system including a composite tendon comprising an assembly of elongate elements held together. The anchorage system also includes an anchor head including a casing. The individual elongate elements are separated from each other at one end, the separate elements extending into the anchor head; The anchor head casing is filled with an adhesive medium to secure the separated elements in the casing.

Preferably the assembly of elongate elements includes a primary wire and a plurality of secondary wires wound around the primary wire.

The anchor head in the anchorage system may further include an anchor plate adapted to be secured to a bearing plate.

In the anchorage system the primary and/or secondary wires are preferably made of fibre reinforced polymer (FRP), and more preferably carbon fibre reinforced polymer (CFRP). Alternatively the wires may be made of aramid fibre reinforced polymer (AFRP) or glass fibre reinforced polymer (GFRP).

The adhesive medium in the anchor head casing is preferably made of cementitious grout. The grout may be made from normal strength cementitious grout, high strength grout mixtures, expansive grout mixtures or concrete. Alternatively the adhesive medium may be resin based grout, such as, polyester resin, vinyl ester resin and epoxy resin.

The anchor head and the bearing plate are preferably made of metal, such as, mild steel, high strength steel, carbon steel, stainless steel or galvanised steel.

Alternatively the anchor head and/or bearing plate may be made of non-metal based materials, including plastics, resins, ceramics, fibrous products and polymers.

According to another aspect of the present invention there is provided a method for installing an anchorage system including the steps of:

inserting in a borehole at least one composite tendon comprising an assembly of elongate elements held together;

separating the individual elongate elements from each other over a pre-determined anchor head length;

placing an anchor head casing around the separated elements; and filling the anchor head casing with an adhesive medium, thereby once the adhesive medium has set, the separated elements are securely fixed into the anchor head.

Preferably the composite tendon comprising an assembly of elongate elements held together includes a primary wire and a plurality of secondary wires wound around the primary wire. The secondary wires are preferably unwound from the primary wire of the composite tendon to separate the individual elongate elements from each other The cables may be manually unwound in situ. Alternatively, the cable may be supplied with the secondary wires unwound from the primary wire at one end of the cable.

BRIEF DESCRIPTION OF THE DRAWINGS

Preferred embodiments of the present invention will now be described with reference to the accompanying drawings. These embodiments are given by way of illustration only and other embodiments of the invention are possible. Consequently, the particularity of the accompanying drawings is not to be understood as superseding the generality of the preceding description.

In the drawings.

DESCRIPTION OF PREFERRED EMBODIMENT

Embodiments of the anchorage system will now be described with reference to the accompanying drawings.

Figure 1:
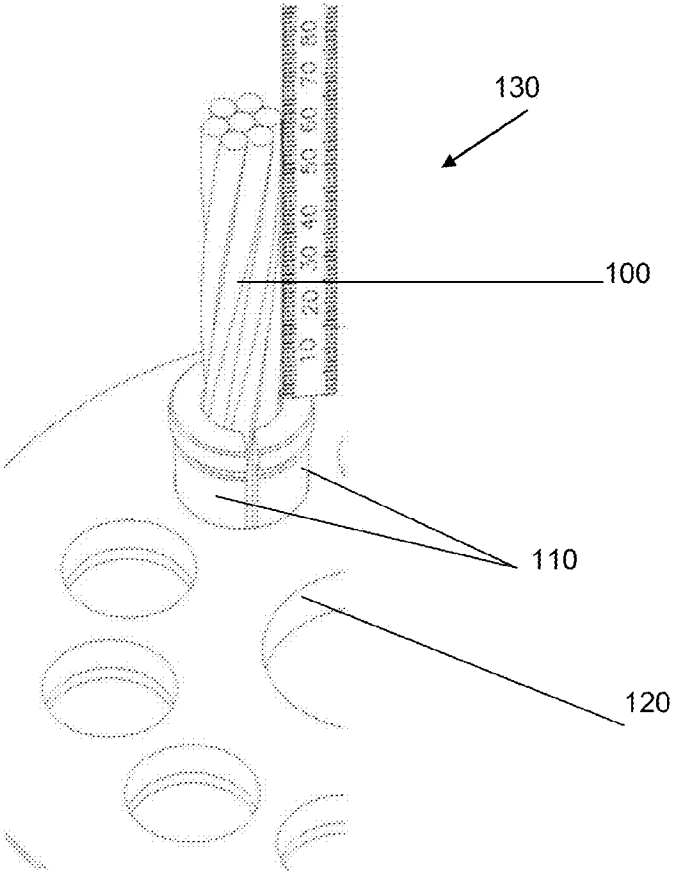
FIG. 1 shows an existing wedge type anchorage system.
Figure 2:
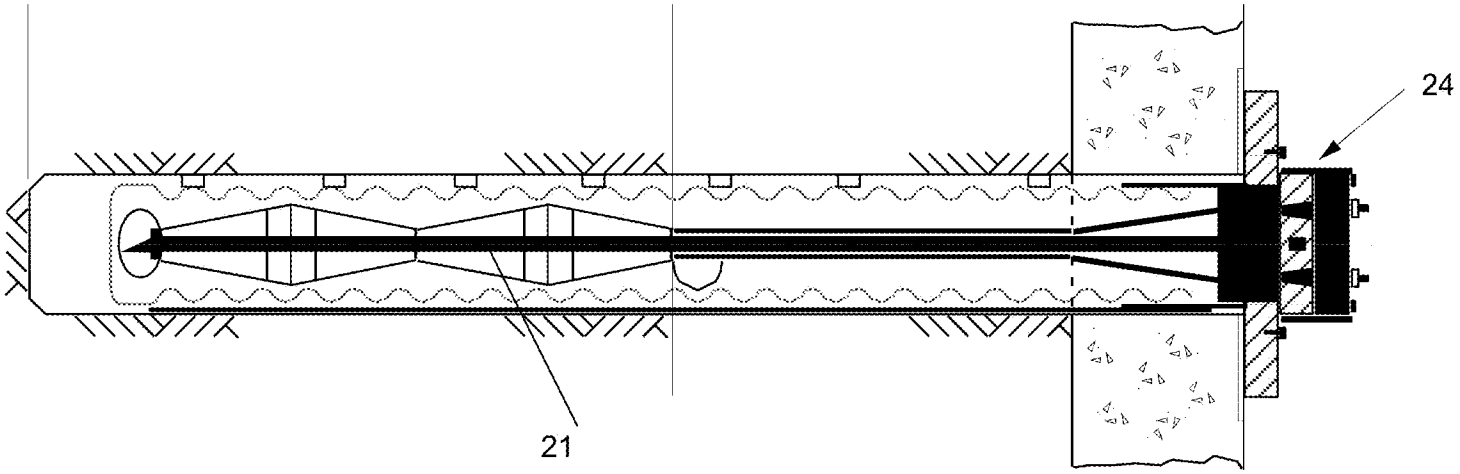
FIG. 2 is a schematic drawing of an existing anchorage system.

FIG. 2 shows a cross-section through an existing anchorage system in which pre-stressed tendons 21 are anchored in boreholes with anchor heads 24 at one end of each tendon 21. Failure can occur in the tendon 21 which can result in the anchor breaking. The failure may occur due to corrosion or other damage of the tendon and/or anchor head system or because the anchor head system is deficient in some way. The risk of failure in such an anchorage system may be significantly reduced if the tendon is replaced by a composite tendon and using anchor heads in accordance with the present invention. The wedge type anchorage system shown in FIG. 1 and the anchor head 24 in FIG. 2 can be replaced with the anchorage system in accordance with the present invention (an embodiment of which is shown in FIG. 3) in order to reduce the risk of failure.

In general, the present invention relates to an anchorage system including a composite tendon comprising an assembly of elongate elements held together. It also includes an anchor head including a casing. The individual elongate elements are separated from each other at one end, the separate elements extending into the anchor head. The anchor head casing is filled with an adhesive medium to secure the separated elements in the casing.

Figure 3:
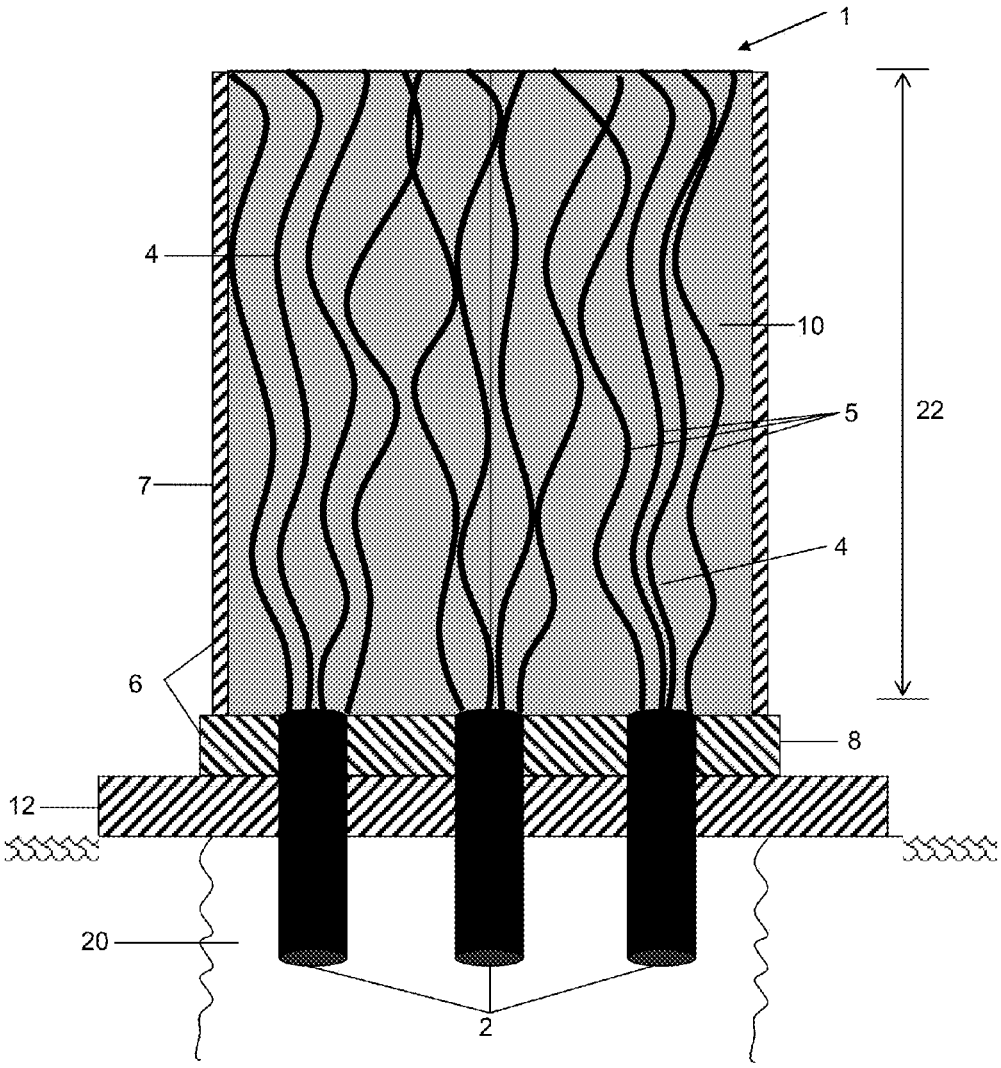
FIG. 3 is a cross-section schematic drawing of an anchorage system in accordance with an embodiment of the present invention.
Figure 4:
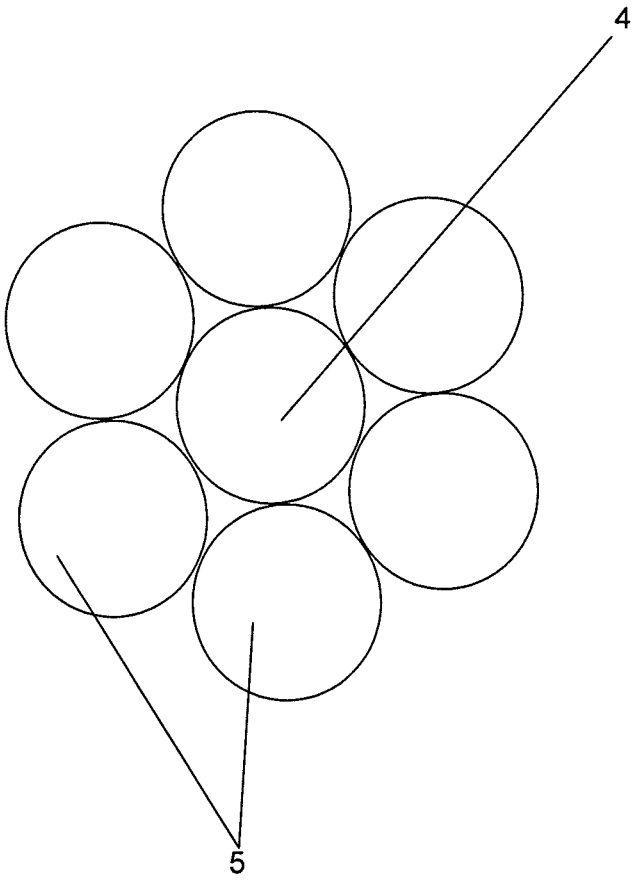
FIG. 4 is a cross-section schematic drawing through one of the cables of FIG. 3 in which secondary wires are wound around the primary wires.

FIGS. 3 and 4 illustrate a schematic drawing of an anchorage system according to a preferred embodiment of the present invention. The anchorage system 1 includes at least one composite tendon 2 having an assembly of elongate elements held together in the form of a primary wire 4 and a plurality of secondary wires 5 wound around the primary wire 4 as shown in FIG. 4. The anchorage system also includes an anchor head having a casing 6. FIG. 3, which illustrates the installation of the anchorage system, shows the individual elongate elements are separated from each other at one end, whereby the secondary wires 5 are unwound from the primary wire 4 at an end of the composite tendon 2 so that each wire 4, 5 of the tendon 2 is separated from other wires. The unwound wires 4, 5 extend into the anchor head casing 6. The anchor head casing 6 is filled with an adhesive medium 10 to secure the unwound wires 4, 5 in the casing 6.

The anchor head casing 6 as shown in FIG. 3 has a longitudinally extending peripheral wall 7 of cylindrical shape although different shapes of casing may be provided. The anchor head casing 6 also includes an anchor plate 8 adapted to be secured to a bearing plate 12.

The primary 4 and/or secondary 5 wires are preferably made of fibre reinforced polymer (FRP). More preferably they are made of carbon fibre reinforced polymer (CFRP). Alternatively they may be made of aramid fibre reinforced polymer (AFRP) or glass fibre reinforced polymer (GFRP).

In FRP materials a polymeric matrix is used to bond the fibres, protect the fibres against environmental effects and assist in the equalisation of fibre forces and load transfers in the transverse direction. Thermoplastic and thermoset polymers can be applied with FRP fibre filaments to form an FRP composite material. Thermoset polymers including epoxy, polyester and vinyl ester are preferred resins for FRP material selection in permanent ground anchor applications.

In a preferred embodiment, the anchorage system 1, as shown in FIGS. 3 and 4, is constructed by inserting in a borehole 20 at least one tendon 2 having a primary wire 4 and a plurality of secondary wires 5 wound around the primary wire 4. The tendon and wires are preferably made of FRP. The secondary wires 5 are then unwound from the primary wire 4 of the at least one cable 2 over a pre-determined bonded anchor head length 22, ensuring each FRP wire is separated from each other. The wires are naturally curved, thus they remain unwound without a physical barrier needing to be used to hold them in place. Furthermore no additional support is required to keep the wires separated from each other. The unwinding does not affect or negatively alter the macro/micro structure of the FRP wires nor does it decrease the engineering properties, such as strength parameters of the FRP wires.

Once the wires are unwound over the pre-determined bonded anchor head length 22, an anchor head casing 6 is placed around the outside of the unwound wires 4, 5. The tendons 2 extend through the anchor bearing plate 12. It is undesirable to have a long anchor head bond length. The present invention enables the anchor head bond length to be kept to a minimum.

The anchor head casing 6 is not limited to metal; non-metal materials can be used for this casing. However, preferably the anchor head casing is made of metal, which may include mild steel, high strength steel, carbon steel, stainless steel or galvanised steel. Alternatively, if the anchor head casing is made of non-metal based materials, plastics, resins, ceramics, fibrous products and polymers can be used.

The anchor head casing 6 may then be secured to a bearing plate 12 and then filled with an adhesive medium 10. The adhesive medium can be cementitious (grout based) or synthetic (resin or epoxy based). Preferably the adhesive medium is made of cementitious grout. This may include standard strength grout mixtures, high strength grout mixtures, expansive grout mixtures or concrete. Alternatively the adhesive medium may be resin based grout including polyester resin, vinyl ester resin or epoxy resin.

Once the adhesive medium 10 has set, the unwound wires 4, 5 are securely fixed into the anchor head. This process of unwinding the FRP wires and fixing them with grout increases the total surface area between the FRP wires and the surrounding adhesive medium. This increases the total frictional area used to resist applied forces through from the stressing of the ground anchor. Where the wires are fixed to the surrounding adhesive medium 10 forms an area whereby the ground anchor can then be stressed and locked off, holding the required engineered loads for its application, for example a bridge, dam or car park.

This system utilises bond forces generated between the extended surface area of the unwound FRP wires and adhesive material, and between the adhesive material and the surrounding anchor head casing. No mechanical interlocking between the FRP wire and the adhesive material or anchor head casing is used to establish load lock off In addition, the tendons 2 may be manually unwound. The unwinding process does not interfere or alter the properties of the wires. This is due to the tendon or wires not being physically changed, for example, by cutting. Only their physical configuration is altered; each wire is intact, but separated from the other wires.

Since the bonding surface area is increased, thus the anchorage system is able to support a larger force than conventional anchorage systems. The anchorage system is able to reduce the required anchor head bond length to successfully support the ultimate tensile capacity of the anchor system. Current FRP guidelines (ACI440.3R-04: Guide Test Methods for Fibre-Reinforced Polymers (FRPs) for Reinforcing or Strengthening Concrete Structures) recommend a much longer bond length for various FRP materials, but by using the present invention, the bond length can be significantly reduced.

This reduction in required anchor bond length has substantial benefits including system approval for works in areas where completed surface space is a premium, material cost, labour cost, easier manhandling both during fabrication and onsite. The anchorage system described above enables the preconstruction of the anchor head system prior to installation, thus fabrication and quality control can be more easily monitored.

By way of illustration, FIG. 3 shows a three tendon anchorage system having three tendons two each with four wires 4, 5. However, the number of wires in each tendon, and the number of tendons in the anchorage system may be varied for different applications.

As shown in FIG. 4, six secondary wires 5 are wound around a central primary wire 4 of similar diameter. It will, however, be appreciated that the number of secondary wires and the relative diameters of the primary and secondary wires may be varied.

The FRP tendon of FIG. 4 comprises seven wires, each approximately 5 mm in diameter. Each secondary wire is individually manufactured, then helically twisted around the primary wire. Furthermore, the tendon may be pre-manufactured.

The bearing plate 12 is preferably (like the anchor head) made of metal. Alternatively, it may be made of non-metal based materials.

Unlike many other anchorage systems, the present invention does not use a tapered wedge system to lock each wire into place once a load is applied. In this anchorage system, all the unravelled secondary wires are grouted in one medium. As such, the unravelled wires within the pre-determined bonded length 22 effectively act as one uniformly tensioned system during the stressing phase.

Stressing of bond type anchor head system can be conducted as per conventional anchor stressing procedures. Hydraulic jacks can be placed under the anchor head system 1 and are used to place an applied load (of known amount) into the anchor tendon. Once the system has reached its design lock-off load shims are used to lock the anchor head system into place. Once the shims are in place, jacks are removed and the anchor is classified as stressed.

Figure 5:
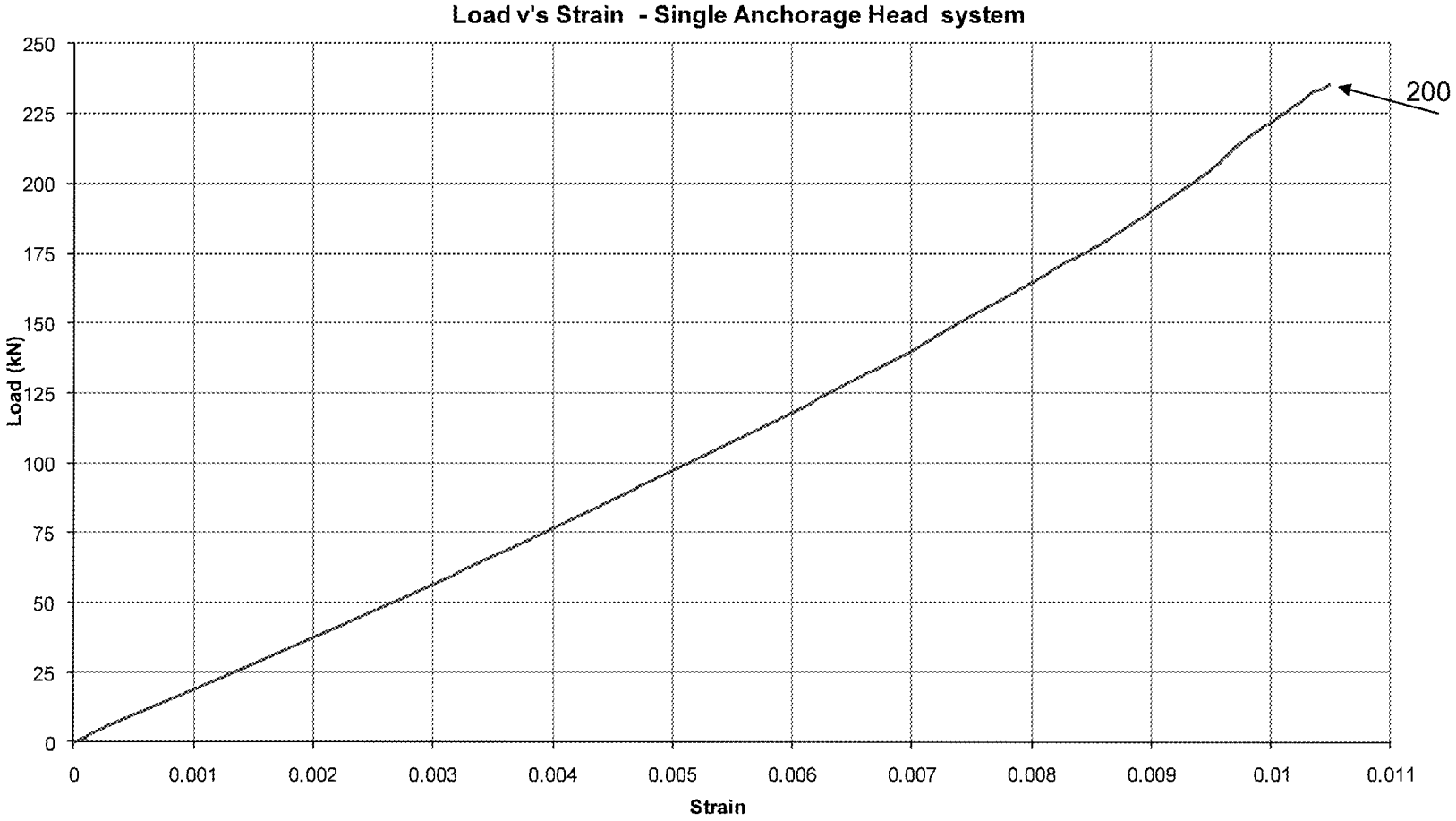
FIG. 5 is a graph showing load verses strain results for an existing single CFRP tendon anchorage head system.
Figure 6:
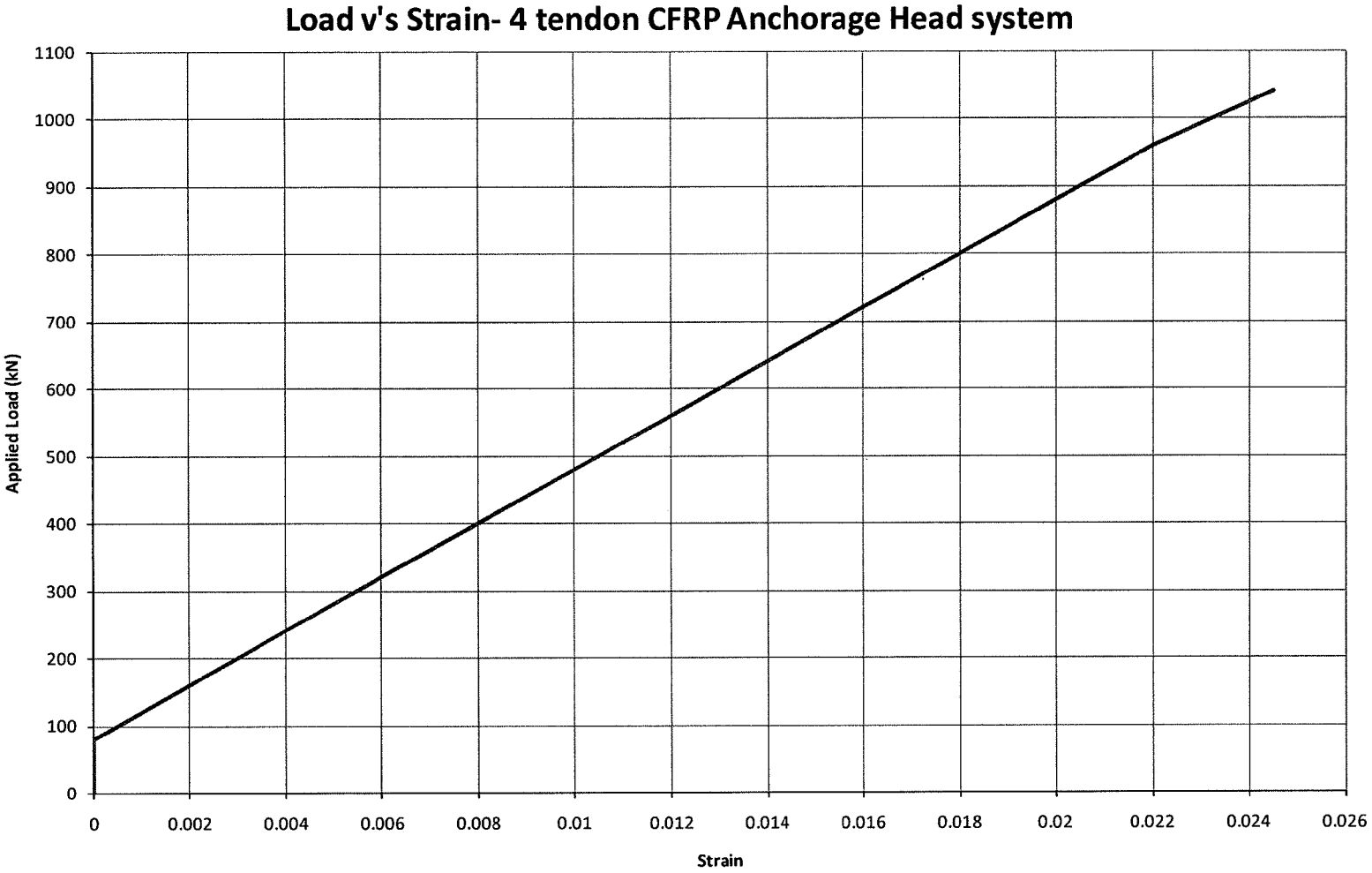
FIG. 6 is a graph showing load verses strain results for a four CFRP tendon anchorage head system in accordance with an embodiment of the present invention.

Results from a series of tests to verify advantageous properties of an anchor head system according to the invention are shown in the graphs of FIGS. 5 and 6. These results conclude that linear tendon elasticity occurred prior to tendon failure.

FIG. 5 shows the load verses strain characteristics which result for an existing single CFRP tendon anchorage head system. These results show a linear extension prior to brittle failure of the tendon 200.

FIG. 6 shows the load verses strain characteristics which result for a four CFRP tendon anchorage head system according to an embodiment of the present invention. The results also show a linear extension of the tendon, however, a failure point did not occur in this system, thus the bond type anchorage system successfully withholds the full capacity of the CFRP tendon. The tendon in the four CFRP tendon anchorage head system can withstand equivalent or higher applied loads than existing anchorage head systems as can be seen in FIGS. 5 and 6.

Figure 7:
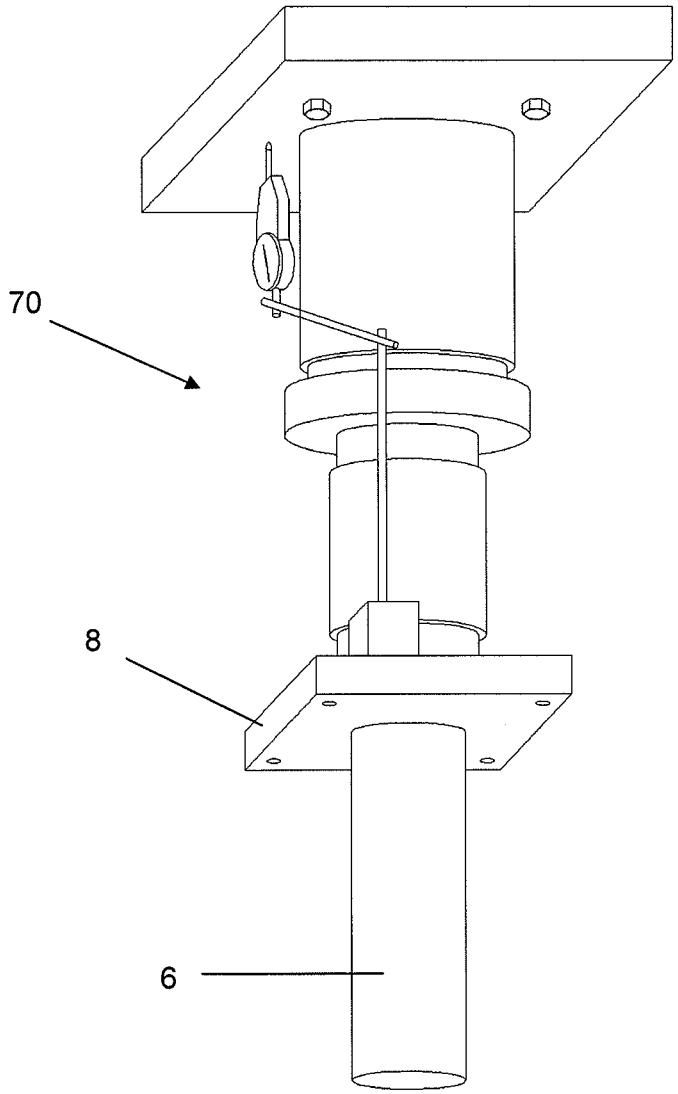
FIG. 7 is a cross-section of a four tendon anchorage head system in accordance with an embodiment of the present invention, post testing.
Figure 8:
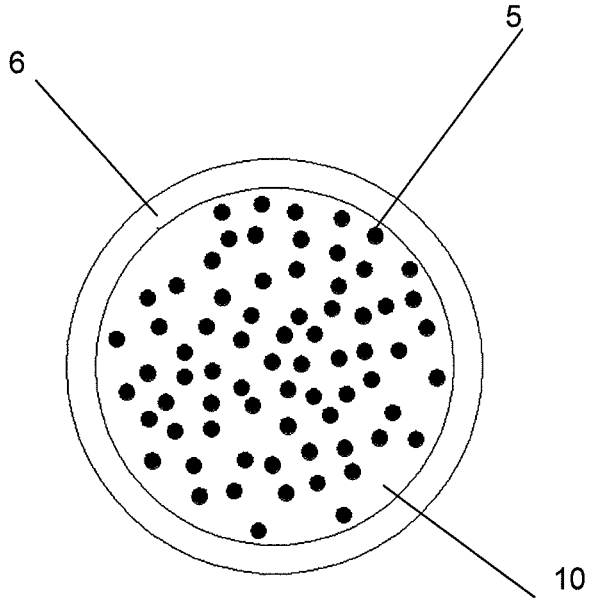
FIG. 8 is an assembled four tendon CFRP anchor head system, in accordance with an embodiment of the present invention, under load.

FIG. 7 shows an assembled ten tendon CFRP anchor head system under load. The anchor head casing 6 and the anchor head plate 8 are shown on the left hand side of FIG. 7 and the apparatus 70 for placing the tendons of the anchorage system under load is shown on the right side of FIG. 7. FIG. 8 shows a cross-section through the anchor head casing 6 of the ten tendon anchorage head system post testing of FIG. 7. As can be seen, within the anchor head casing 6 there are ten tendons each with seven wires 5, forming 70 wires 5 in total. The wires 5 in the tendon have been unwound and grouted in a medium 10, effectively acting as one uniformly tensioned system during the stressing phase.

As the present invention may be embodied in several forms without departing from the essential characteristics of the invention, it should be understood that the above described embodiment should not be considered to limit the present invention but rather should be construed broadly. Various modifications and equivalent arrangements are intended to be included within the spirit and scope of the invention.

The invention claimed is:

1. An anchorage system comprising:

a plurality of composite tendons, each composite tendon including a first end and a second end, wherein the first end includes an assembly of elongate elements wound together, the elongate elements including a primary wire and a plurality of secondary wires wound around the primary wire, and wherein, at the second end, the elongate elements are separate and spaced apart from each other; and an anchor head including a casing, wherein, for each composite tendon, the first end is located in a borehole and is structurally positioned such that the elongate elements at the second end extend into the anchor head, and wherein, for each composite tendon, the elongate elements at the second end are secured in the casing of the anchor head by an adhesive medium in the casing.

2. An anchorage system according to claim 1, wherein the anchor head further includes an anchor plate adapted to be secured to a bearing plate.

3. An anchorage system according to claim 2, wherein the bearing plate is made of a metal, including at least one of: a mild steel, a high strength steel, a carbon steel, a stainless steel, and a galvanised steel.

4. An anchorage system according to claim 2, wherein the bearing plate is made of a non-metal based material, including at least one of: a plastic, a resin, a ceramic, a fibrous product, and a polymer.

5. An anchorage system according claim 1, wherein one or both of the primary wire and the secondary wires is or are made of fibre reinforced polymer (FRP).

6. An anchorage system according to claim 5, wherein the fibre reinforced polymer (FRP) of one or more of the wires is selected from carbon fibre reinforced polymer (CFRP), aramid fibre reinforced polymer (AFRP), and glass fibre reinforced polymer (GFRP).

7. An anchorage system according to claim 1, wherein the adhesive medium is made of cementitious grout, including at least one of: normal strength cementitious grout, high strength grout mixtures, expansive grout mixtures, and concrete.

8. An anchorage system according to claim 1, wherein the adhesive medium is a resin based grout, including at least one of: polyester resin, vinyl ester resin, and epoxy resin.

9. An anchorage system according to claim 1, wherein the anchor head is made of metal, including at least one of: mild steel, high strength steel, carbon steel, stainless steel, and galvanised steel.

10. An anchorage system according to claim 1, wherein the anchor head is made of a non-metal based material, including at least one of: a plastic, a resin, a ceramic, a fibrous product, and a polymer.

11. A method for installing an anchorage system, comprising steps of:

obtaining a plurality of composite tendons, each composite tendon including a first end and a second end;

inserting in a borehole the first end of each composite tendon, wherein the first end includes an assembly of elongate elements wound together, the elongate elements including a primary wire and a plurality of secondary wires wound around the primary wire;

for each composite tendon at the second end thereof, separating individual ones of the elongate elements from each other over a pre-determined bonded anchor head length, such that the elongate elements are spaced apart from each other;

placing an anchor head casing around the separate and spaced apart elongate elements of the composite tendons; and filling the anchor head casing with an adhesive medium, wherein, once the adhesive medium has set, the separate and spaced apart elongate elements of the composite tendons are securely fixed into an anchor head corresponding to the anchor head casing.

12. A method for installing an anchorage system according to claim 11, wherein in the separating step the secondary wires are unwound from the primary wire of the composite tendon to separate the individual ones of the elongate elements from each other.

13. A method for installing an anchorage system according to claim 12, wherein the wires are manually unwound.

* * * * *